US006526701B2

(12) United States Patent
Stearns et al.

(10) Patent No.: US 6,526,701 B2
(45) Date of Patent: Mar. 4, 2003

(54) ROOF MOUNT

(75) Inventors: Brian C. Stearns, Stowe, VT (US); Alan L. Stearns, Stowe, VT (US)

(73) Assignee: Vermont Slate & Copper Services, Inc., Morrisville, VT (US)

( * ) Notice: Subject to any disclaimer, the term of this patent is extended or adjusted under 35 U.S.C. 154(b) by 0 days.

(21) Appl. No.: 09/731,100

(22) Filed: Dec. 6, 2000

(65) Prior Publication Data

US 2002/0066235 A1 Jun. 6, 2002

Related U.S. Application Data

(60) Provisional application No. 60/216,143, filed on Jul. 3, 2000.

(51) Int. Cl.[7] ..... E04D 13/00
(52) U.S. Cl. ..... 52/24; 52/545; 248/237
(58) Field of Search ..... 52/24–26, 545; 182/45; 256/1, 12.5, 65; 248/237

(56) References Cited

U.S. PATENT DOCUMENTS

| | | | |
|---|---|---|---|
| 473,512 | A | 4/1892 | Laird |
| 756,884 | A | 4/1904 | Parry |
| 1,925,263 | A | 9/1933 | Levow |
| 2,079,768 | A | 5/1937 | Levow |
| 3,182,762 | A | 5/1965 | Syak et al. |
| 3,633,862 | A | 1/1972 | Breen |
| 3,880,405 | A | 4/1975 | Brueske |
| 4,367,864 | A | 1/1983 | Eldeen |
| 4,927,305 | A | 5/1990 | Peterson |
| 5,217,191 | A | 6/1993 | Smith |
| 5,228,248 | A | 7/1993 | Haddock |
| 5,431,372 | A | 7/1995 | Kostelecky |
| 5,609,326 | A | 3/1997 | Stearns et al. |
| 5,613,328 | A | 3/1997 | Alley |
| 5,685,508 | A | 11/1997 | Smith |
| 5,983,588 | A | 11/1999 | Haddock |

FOREIGN PATENT DOCUMENTS

| | | |
|---|---|---|
| CH | 204783 | 1/1939 |
| CH | 671063 A5 | 7/1989 |
| DE | 3716-491 A1 | 1/1988 |
| DE | 3723-020 A1 | 1/1989 |
| GB | 666147 | 2/1952 |
| JP | 5-346055 | 1/1991 |

OTHER PUBLICATIONS

Product Advertisement, "Alpine Snowguards/Setting the Industry Standard/Snow Guards for Every Roof Type" Mar. 27, 2000.

(List continued on next page.)

*Primary Examiner*—Lanna Mai
(74) *Attorney, Agent, or Firm*—Fish & Richardson P.C.

(57) ABSTRACT

A roof mount includes a base member and an attachment mount. The base member has a protrusion, and the attachment mount defines a hollowed region for receiving the protrusion to form a compression fitting. A substantially leak proof assembly is formed when the attachment mount is placed against the base member with a sealing material therebetween and a connecting element for coupling the attachment mount to the base member extends through the sealing material. A spacer extends the base member to a roof surface. The spacer is a hollow base stand, a tube, or a side wall of the base member. The spacer has a surface area covering the roof deck less than the surface area of a side of the base member facing the roof deck. The invention includes a method of limiting wind uplift of a roof.

46 Claims, 15 Drawing Sheets

OTHER PUBLICATIONS

MacDonald, "Inspecting the Scaffold" and Protective Roofing Products LTD. advertisement, (undated), *Roofing Contractor 6.00*.

"Fall Protection in Contruction", *OSHA Laws 3146*; 1995.

Product Advertisement, "Speedstand",—*Contractors Guide*, Jun. 2000.

Product Advertisement—Sarna, Sarnafil Division (undated).

Product Description—"An Innovative Approach to Zero Roof Penetrations", *Portable, Pipe Hangers, Inc.*, printed Jul. 2000.

Product Description—"Flat Roof Safety System", *POHL Roof and Safety Systems,Securant*, (undated).

Product Description—"Gecko–An Introduction", *Gecko Safety Systems, Fall Arrest Protection*, printed Jul. 2000.

Product Description—"Instruction and Specification Manual, Super Anchor: Fall Arrest Anchor. ARS–2×8 and ARS–2×12", 1993.

Product Description—"Super Anchor: Instruction/Specification Manual: Stainless Steel Fall Arrest Anchors ARS 2×8, ARS 2×12, I–Joist, Moveable ARS, Vertical Wall Anchor, and Custom Anchor", Mar. 2000.

Product Description—Anchor Guardrails, printed Aug. 2000.

Product Description—FLUX–Boy (undated).

Product Description—Gecko–An Introduction, Gecko Safety Systems, Ltd., printed Mar. 2000.

Product Description—Portable Pipe Hangers, Inc., *Inter517face*, Jun. 2000.

Product Description—Portable Pipe Hangers, printed Aug. 2000.

ROOF MOUNT

This application claims priority to provisional application U.S. Ser. No. 60/216,143 filed Jul. 3, 2000. This invention relates to roof mounts, and more particularly to a universal roof mount for attaching structures to a roof.

BACKGROUND

Roof mounts are generally used to attach structures such as safety railings and snow guards to a roof. Roof mounts are available for attaching structures to various roofing materials, for example, seamed or metal roofs, wood roofs, and membranous roofs. A roof mount particularly suited for use on membranous roofs is disclosed in applicants' prior U.S. Pat. No. 5,609,326, entitled Impervious Membranous Roof Snow Fence System, hereby incorporated by reference in its entirety.

Currently, when attaching a roof mount to a roof deck where insulation covers the roof deck, a solid block having at least the same surface area as the roof mount is placed in the installation to space the roof mount from the roof deck.

SUMMARY

According to the invention, a roof mount includes a base member and an attachment mount. The base member has a protrusion extending from a first surface of the base member, and a connecting element, e.g., a threaded bolt. The attachment mount defines a hollowed region for receiving the protrusion to form a compression fitting. A substantially leak proof assembly is formed when the attachment mount is coupled to the base member by the connecting element with a sealing material, e.g., a membrane or metal patch, placed between the attachment mount and the base member and the connecting element extending through the sealing material.

Embodiments of this aspect of the invention may include one or more of the following features.

The connecting element extends from a region of the base member surrounded by the protrusion. A spacer extends the base member to a roof surface. The base member includes a centering protrusion extending from a second surface of the base member, and the spacer defines a hollowed region for receiving the centering protrusion. The base member and the spacer define aligned through holes for receiving a screw for attaching the base member to a roof deck. The spacer is a hollow base stand or a tube. Alternatively, the spacer is formed by a side wall of the base member. The base member defines a hole for receiving a screw for attaching the base member to a roof deck.

In an illustrated embodiment, a coupling component is connected to the attachment mount for coupling a structure to the roof mount. The coupling component is configured to be connected to the attachment mount by the connecting element. In an alternative illustrated embodiment, the attachment mount includes an integral coupling component for coupling a structure to the roof mount.

According to another aspect of the invention, a roof mount includes a base member having a side for facing a roof deck. The side has a surface area. A spacer for extending the base member from the roof deck has a surface area covering the roof deck less than the surface area of the side of the base member.

According to another aspect of the invention, a method of elevating a base member of a roof mount includes forming a void region within insulation covering a roof deck, placing a spacer in the void region, and placing the base member over the elevating member. The spacer has a surface area covering the roof deck less than a surface area of a side of the base member facing the roof deck.

According to another aspect of the invention, a method of limiting wind uplift of a roof includes embedding a spacer within insulation positioned between the roof deck and the roofing, and attaching a base member to the roof deck with the spacer elevating the base member from the roof deck. The base member is positioned over the roofing, and a surface area of the spacer covering the roof deck is less than the surface area of a side of the base member facing the roof deck.

Embodiments of this aspect of the invention may include placing a sealing patch, e.g., a membrane or metal patch, over the base member.

Advantages of the invention may include a roof mount that penetrates a roof for secure attachment to the roof while incorporating a water tight flashing mechanism to limit the possibility of leakage.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
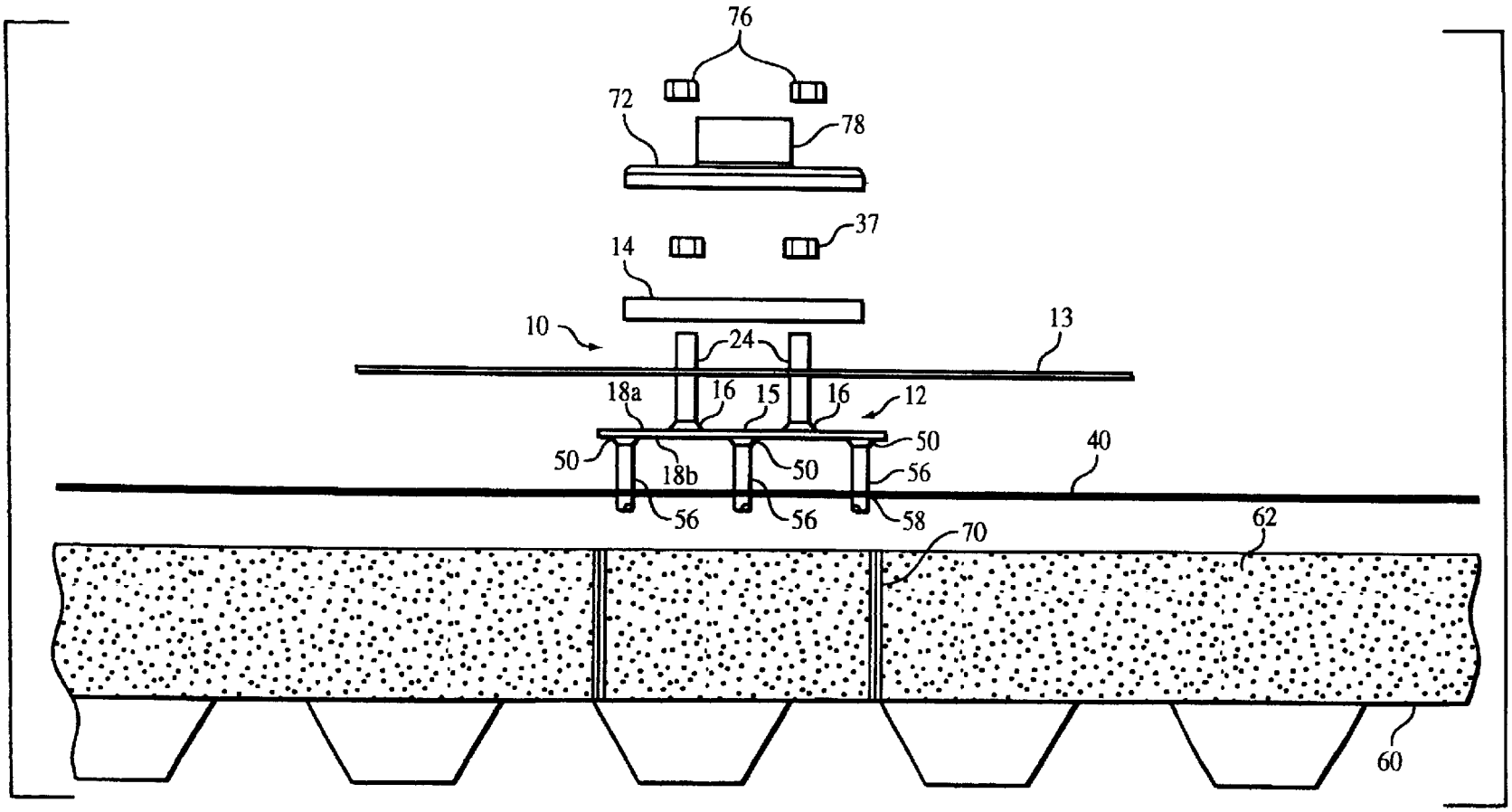
FIG. 1 is an exploded side view of a roof mount shown attaching a coupling component to roof.
Figure 2:
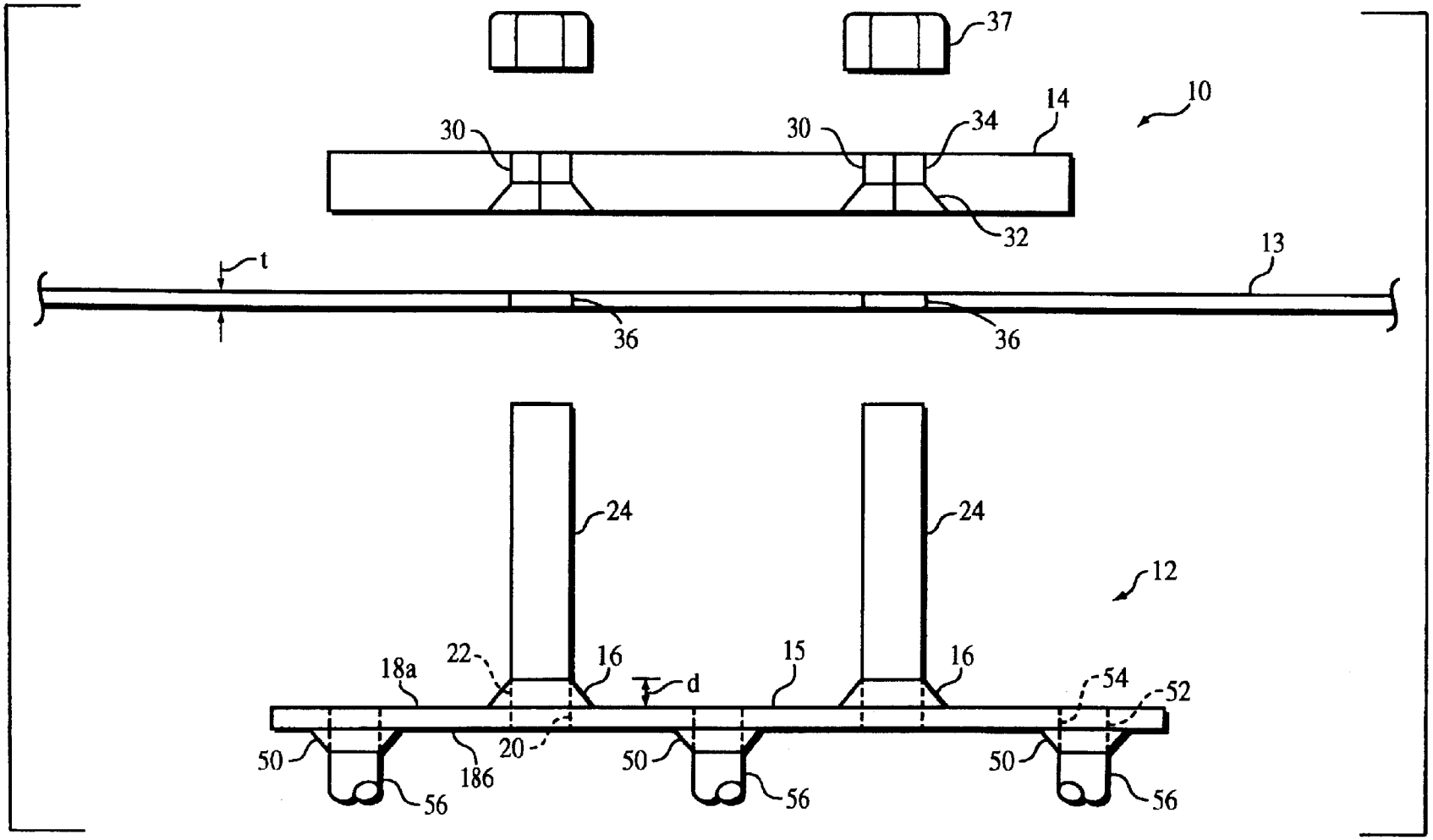
FIG. 2 is an exploded side view of the roof mount of FIG. 1.

Referring to FIGS. 1 and 2, a roof mount 10 for attaching structures such as safety railing and snow guards to a roof includes a base member 12 and an attachment mount 14. When attachment mount 14 is bolted to base member 12 with a sealing material, e.g., a membrane patch 13, positioned therebetween, a compression fitting is formed producing a substantially fluid tight seal between the mount and base member. This limits leakage of moisture from snow, rain and melting ice at the mounting site, potentially damaging the roof deck below.

Base member 12 includes a flat plate 15 with flared protrusions 16 extending from a first side 18*a* of plate 15. Plate 15 defines through holes 20 and protrusions 16 define through holes 22 aligned with holes 20. Each pair of aligned holes 20, 22 receives an attachment member, e.g., a threaded attachment bolt 24. Alternatively, base member 12 can be cast with protrusions 16 and attachment bolts 24 formed integrally with the base member. Mount 14 defines through holes 30, each having a first hollowed, flared region 32 for receiving a protrusion 16, and a second cylindrical section 34 for receiving a bolt 24. Membrane patch 13 has through holes 36 for receiving bolts 24.

Figure 3:
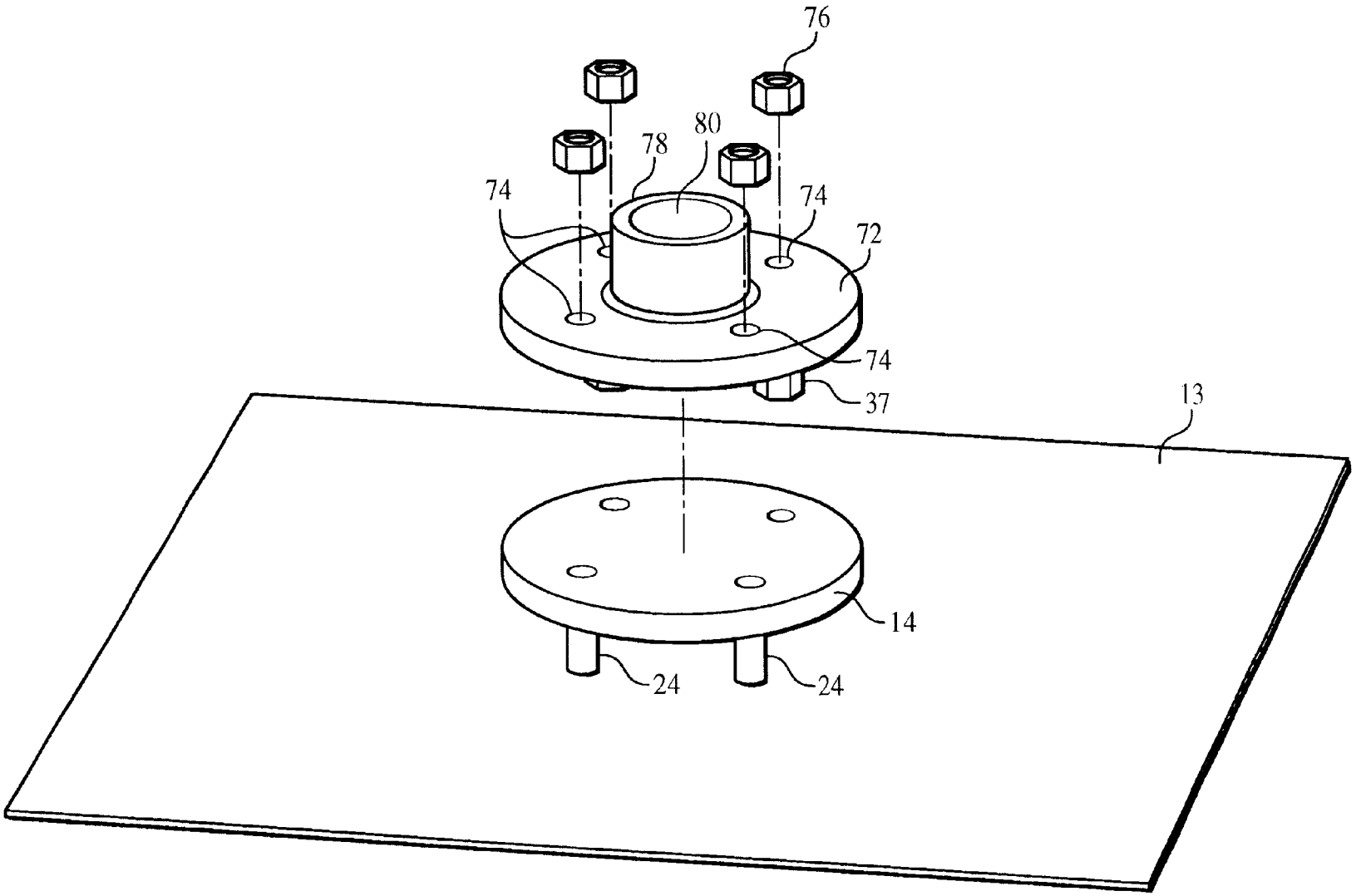
FIG. 3 exploded perspective view of the roof mount and coupling component.

During installation on membrane roofing 40, after base member 12 has been secured to the roof, as described below, membrane patch 13 is placed over base member 12 with bolts 24 extending through patch holes 36. Patch 13 is secured to roofing 40 by, e.g., glue or heat welding. Mount 14 is then placed over patch 13 with bolts 24 extending through mount holes 30. Patch 13 entirely covers base member 12, leaving only bolts 24 exposed (as shown in FIG. 3). Nuts 37 are threaded onto bolts 24 and tightened to secure mount 14 to base member 12. The securing of mount 14 to base member 12 compresses membrane patch 13 with the portions of membrane patch 13 located between hollowed regions 32 and protrusions 16 creating a substantially leak proof compression fitting.

To attach base member 12 to membrane roofing 40, base member 12 includes additional flared centering protrusions 50 extending from a second side 18*b* of plate 15.

Plate 15 defines through holes 52 and protrusions 50 define through holes 54 aligned with holes 52. Each pair of aligned holes 52, 54 receives a threaded attachment screw 56. Screws 56 are inserted through holes 52, 54 from the first side 18*a* of base member 12, then through holes 58 punched in membrane roofing 40, and continue down through the deck surface 60, and any other stabilizing surface such as wood, or metal, of the membrane roof. Nuts (not shown) can be threaded onto screws 56 from below the deck surface to strengthen the attachment of the device to the roof surface.

In certain applications, it is desirable to elevate base member 12 from deck surface 60, for example, to account for the thickness of insulation 62 positioned between the deck surface 60 and membrane roofing 40. For this purpose, a base stand 70, described further below, having the same height as the insulation, is embedded within the insulation at desired anchoring points prior to laying of the membrane roofing 40.

Figure 4:
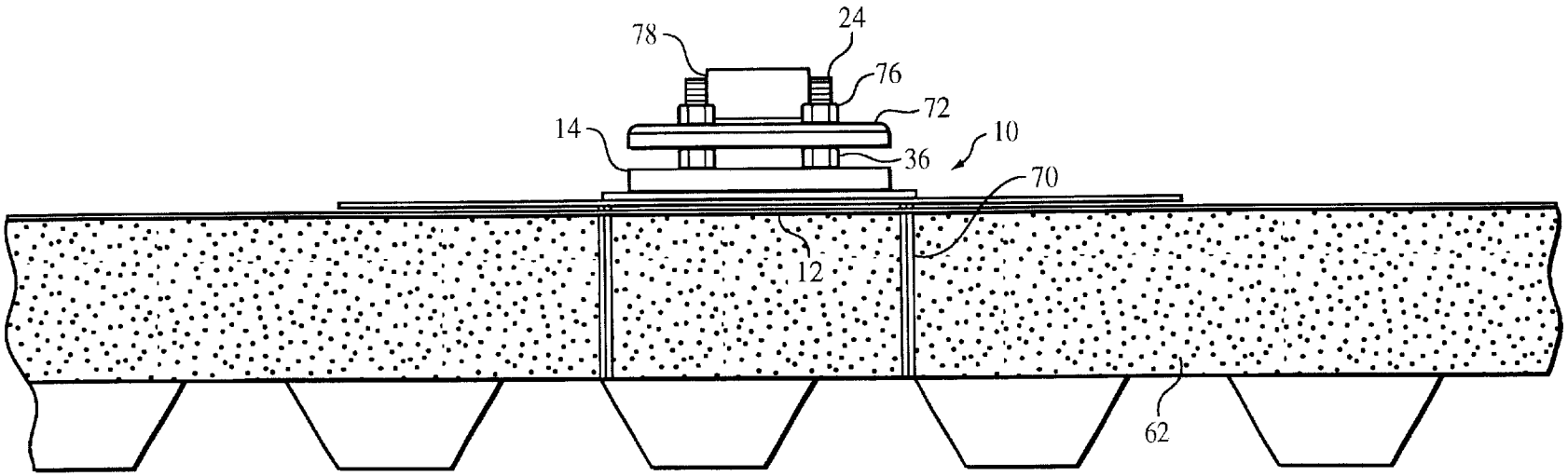
FIG. 4 an assembled side view of the roof mount shown attaching the coupling component to a roof.

Roof mount 12 is a universal mount that can be employed to attach any coupling component to membrane roofing 40. For example, as shown in FIGS. 1 and 3, a coupling component 72 for receiving a removable vertical member (not shown) to which horizontal safety wires or railings (not shown) are attached can be affixed to mount 12. Coupling component 72 includes through holes 74 for receiving bolts 24. Coupling component 72 is secured to mount 14 by positioning bolts 24 through holes 74 and threading nuts 76 onto bolts 24. Coupling component 72 includes an extension 78 defining a threaded hole 80 for receiving the removable vertical member (not shown). Alternatively, coupling component 72 can be integral with mount 14, as described further below with reference to FIG. 8. The assembled roof mount 10 with attached coupling component 72 is shown in FIG. 4.

Base member 12 and mount 14 can take various shapes such as a rectangle, triangle, circle, or pentagon. Protrusions 50 are shown located around the perimeter of plate 15 with protrusions 16 located interior to protrusions 50, though other configurations are possible. Protrusions 16 have a truncated cone shape and extend a distance, d, in the range of about ½ to 1 inch, and preferably about ¾ inches, from side 18*a* of base member 12 to insure an adequate compression fitting. Hollowed region 32 of mount holes 30 is dimensioned to correspond to the shape of protrusions 16. Membrane patch 13 has a thickness, t, in the range of about 0.045 to 0.060 inches. The length and width of membrane patch 13 is selected to be about 6 inches greater than the dimensions of base member 12 to provide adequate coverage of base member 12 to limit the possibility of leakage around base member 12. Membrane patch 13 is formed from, e.g., rubber such as ethylene propylene diene monomer (EPDM).

Figure 5A:
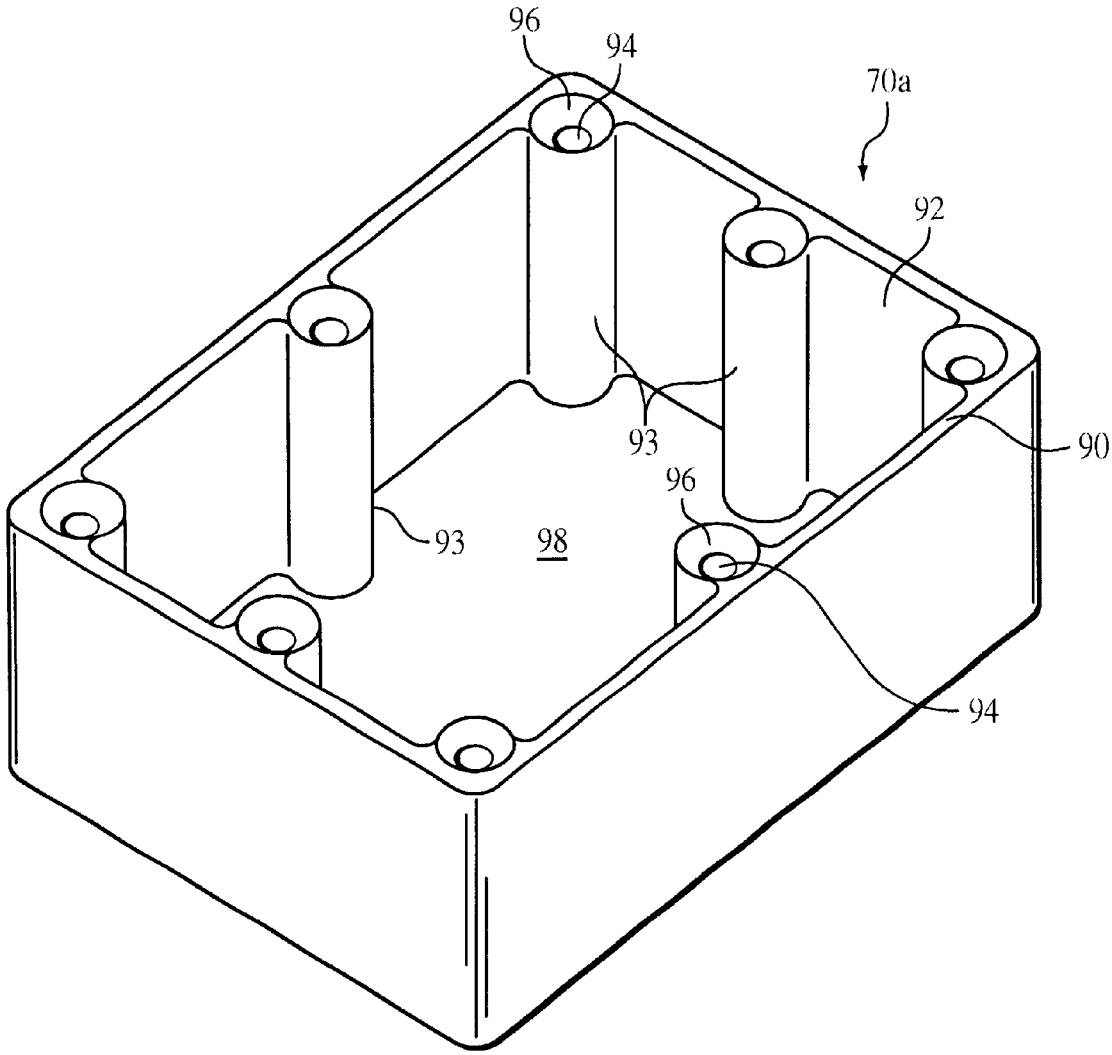
FIG. 5 is a perspective view of a base stand of a roof mount for elevating the roof mount from the roof surface.
FIG. 5B shows a base member of a roof mount for use with the base stand of FIG. 5A.
Figure 5B:
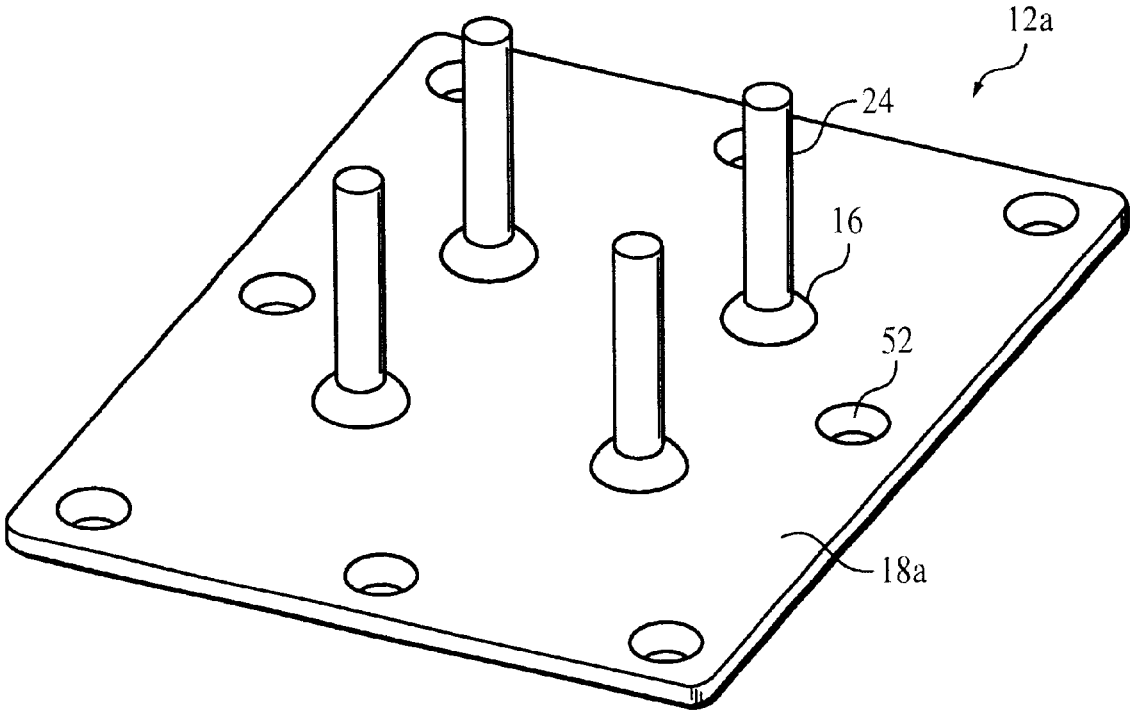

Referring to FIGS. 5A and 5B, a rectangular base stand 70*a* for use with a rectangular base member 12*a* (note base stand 70 of FIG. 1 would preferably have the same shape as base member 12) acts as a spacer for elevating base member 12*a*. Base stand 70*a* includes a wall 90 having an inner surface 92 with a plurality of cylindrical members 93 defining through holes 94 for receiving screws 56. Holes 94 have flared hollowed ends 96 for receiving protrusions 50 on side 18*b* of base member 12, thus allowing base member 12 to sit on top of and lock into base stand 70*a*. Base stand 70*a* has a hollow interior 98 thus minimizing the amount of insulation 62 that is removed to permit placement of base stand 70*a* on the deck surface.

Figure 6:
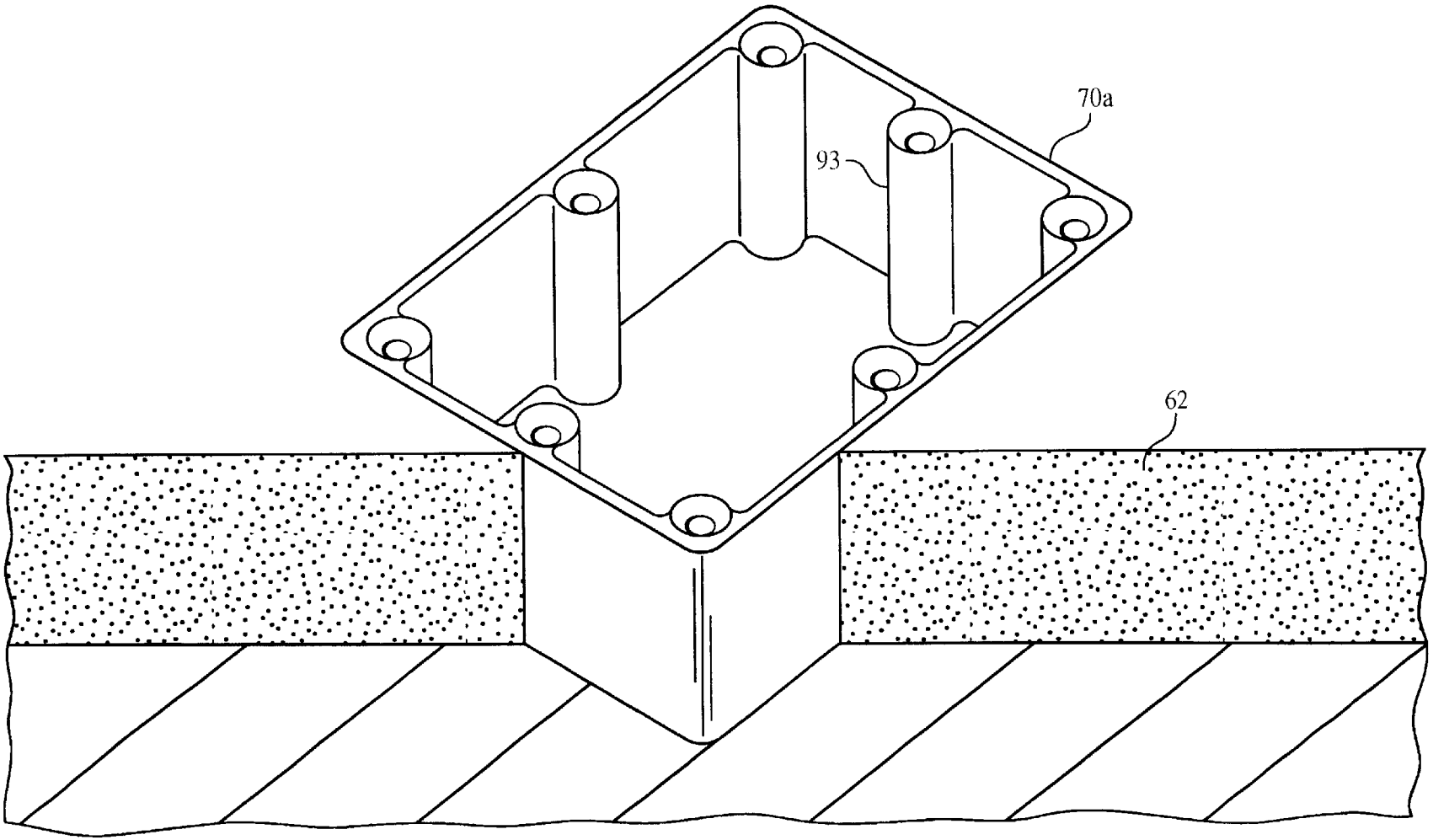
FIG. 6 the base stand of FIG. 5A embedded in roof insulation.

Base stand 70*a* is manufactured at varying heights, e.g., to match the height of roof insulation 62, which generally is in the range of ½ inch to 18 inches, and is embedded in the roof insulation 62 (as shown in FIG. 6) prior to installing membrane roofing 40. (While not shown in FIG. 6, insulation 62 is preferably also within base stand 70*a*.) Membrane roofing 40 is then installed over base stand 70*a* such that the base stand is concealed below the finished membrane roof surface. Screws 56 are then inserted through holes 52, 54 of base member 12, piercing membrane roofing 40, continuing downward through holes 94 of base stand 70*a* to pierce the deck surface, and any other stabilizing surface such as wood or metal, thereby attaching roof mount 10 to membrane roofing 40. Threaded nuts (not shown) can be attached to the ends of the screws from below the deck surface to strengthen the attachment of the device to the roof surface.

Figure 7:
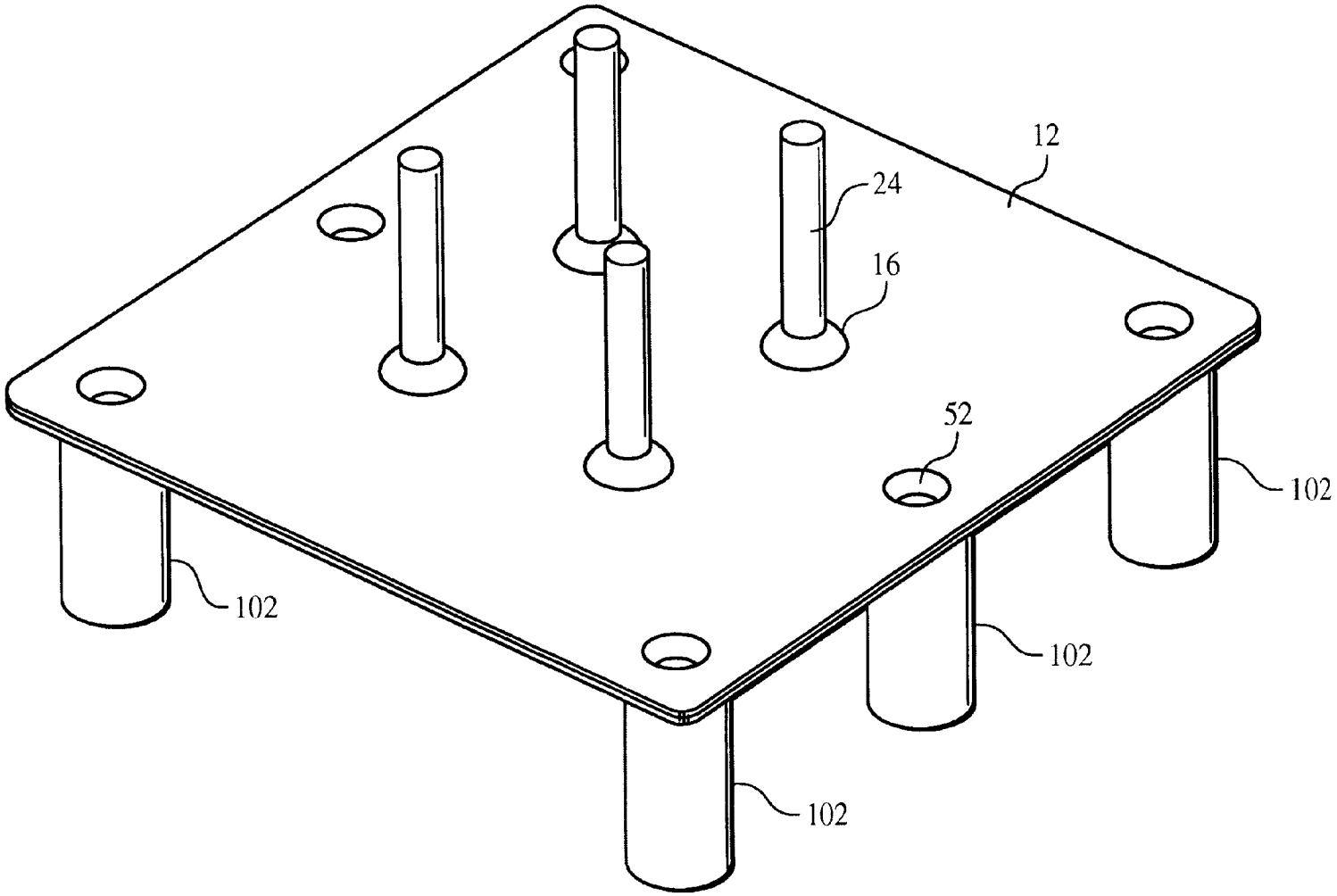
FIG. 7 shows a base member of a roof mount elevated by tubes.

Referring to FIG. 7, another method of elevating base member 12 is to affix base member 12 to hollow tubes 102. Tubes 102 are manufactured at varying heights, e.g., to match the height of the roof insulation 62, and inserted into the roof insulation 62. The only regions of insulation that need be removed are cylindrical sections sized to accommodate tubes 102. Membrane roofing 40 is then installed over hollow tubes 102 such that the hollow tubes are concealed below the finished membrane roof surface. The hollow tubes are spaced in the roof insulation to correspond to the spacing of protrusions 50 on surface 18*b* of base member 12 such that base member 12 sits on top of and locks into tubes 102. Screws 56 are then inserted through base member 12, piercing the membrane roofing, continuing downward within the hollow tubes, then piercing the deck surface, and any other stabilizing surface such as wood or metal thereby attaching the device to the membrane roof surface. Threaded nuts may be attached to the ends of the screws from below the deck surface to strengthen the attachment of the device to the roof surface.

Figure 8:
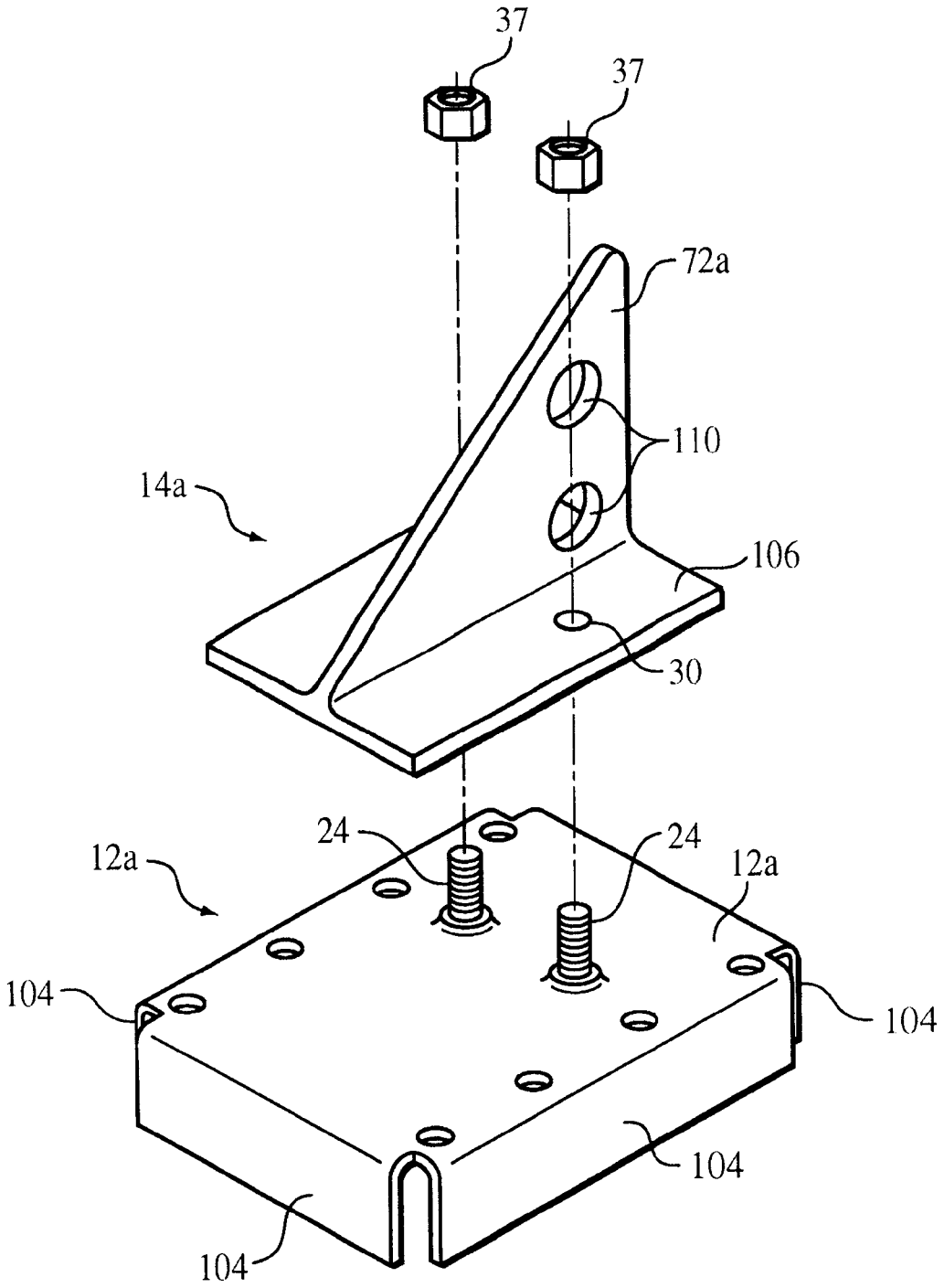
FIG. 8 perspective view of another embodiment of a roof mount including a base member with a vertical elevating flange and a mount with an integral coupling component.
Figure 9A:
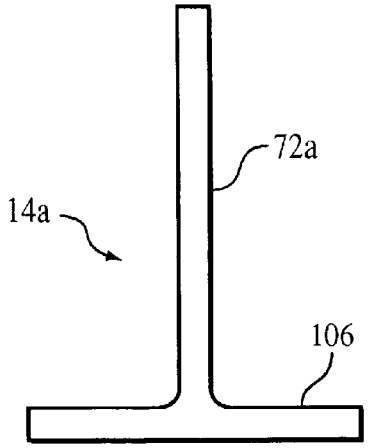
FIGS. 9A–9D are two side views, a bottom view, and a cross-sectional side view, respectively, of the mount with integral coupling component of FIG. 8.
Figure 9B:
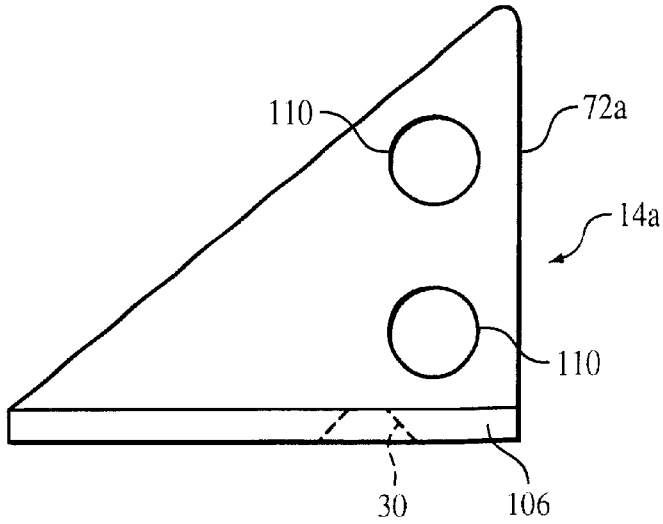
Figure 9C:
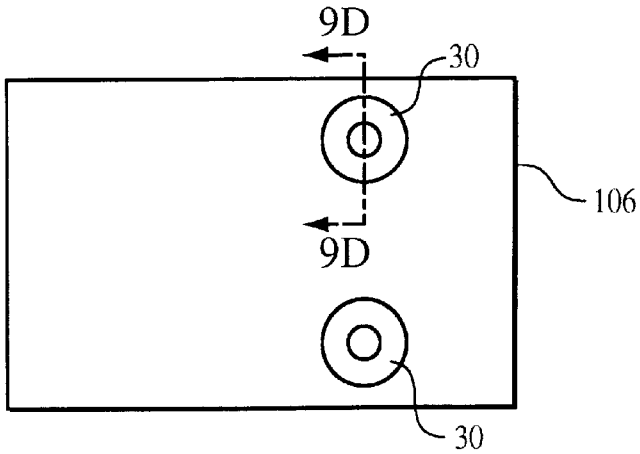
Figure 9D:
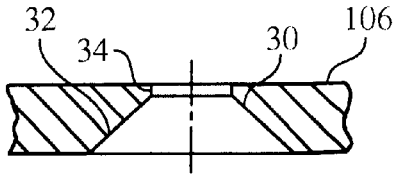

Referring to FIG. 8, another method of elevating a base member 12*a* is to include a vertical flange 104 around the periphery of base member 12*a*. Here, rather than being installed prior to laying of the membrane roof, the elevating mechanism is part of base member 12*a* and is positioned after membrane roofing 40 is in place. Flange 102 is manufactured at varying heights, e.g., to match the height of the roof insulation 62. A hole is cut in membrane roofing 40, and base member 12*a* with bolts 24 is installed over insulation 62 using screws 56 with flange 104 inserted into the roof insulation 62 and extending to the deck surface. A membrane patch 13 is then placed over base member 12. With this method, no insulation need be removed to permit placement of base member 12*a*, rather, insulation is merely displaced by the insertion of flange 104 into the insulation.

Figure 10:
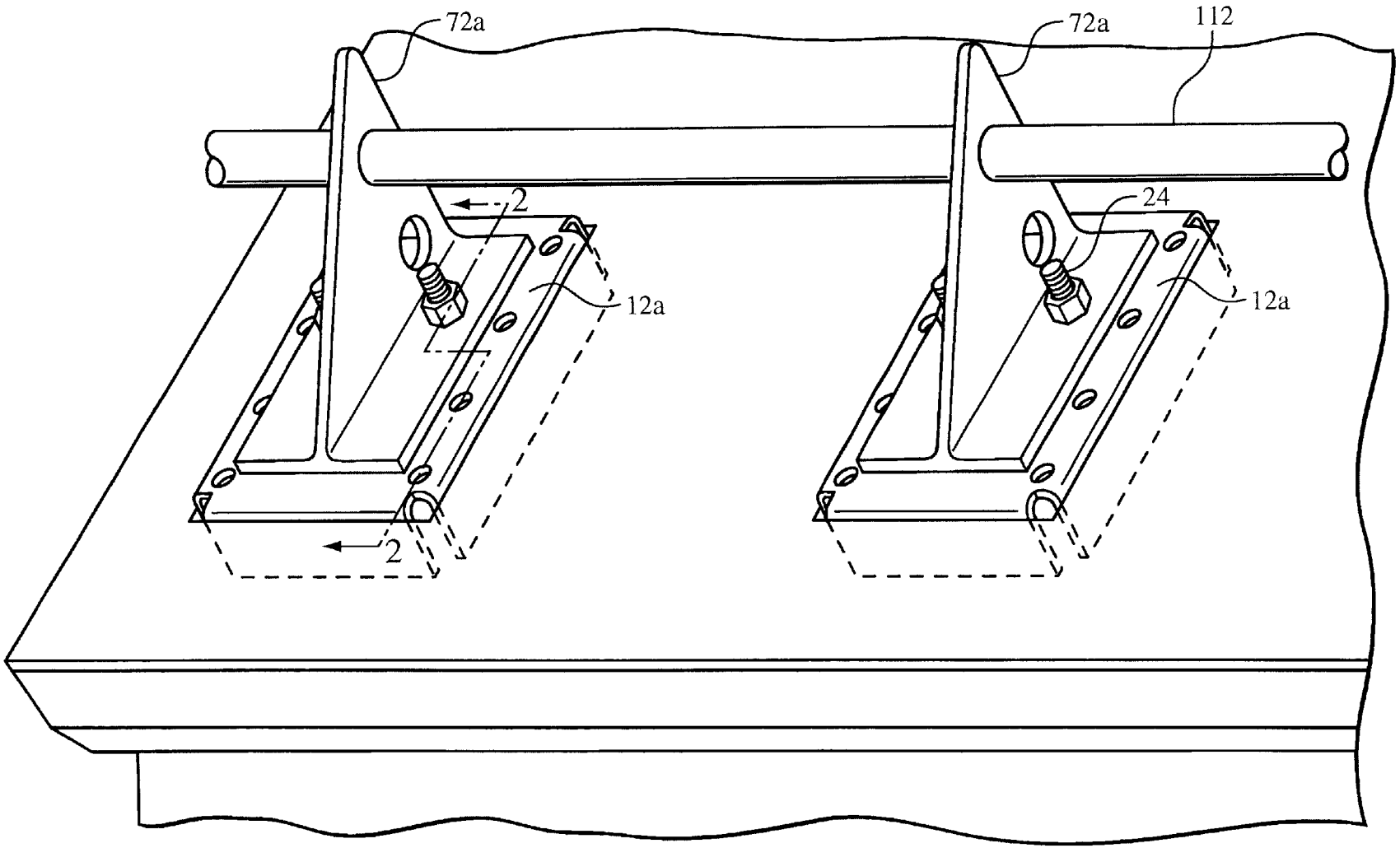
FIG. 10 shows two roof mounts of FIG. 8 attaching a snow guard rail to a roof.

In the embodiment of FIG. 8, an attachment mount 14*a* includes an integral coupling component 72a. Mount 14*a* includes a plate 106 with through holes 30 for receiving bolts 24. Nuts 37 are threaded onto bolts 24 to secure mount 14*a* to base member 12*a*. As described above, base member 12*a* includes protrusions 16 and plate 106 includes hollowed regions 32 for forming a substantially leak proof seal when membrane patch 13 is positioned therebetween. Coupling component 72*a* is triangular in shape and includes two through holes 110 for receiving, e.g., snow rails 112, as shown in FIG. 10. FIGS. 9A-9D are various views illustrating mount 14*a*.

Figure 11A:
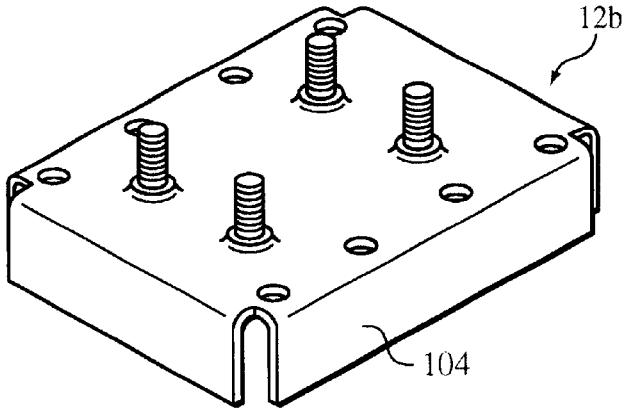
FIGS. 11A-11C are perspective views of additional embodiments of a base member with a vertical elevating flange.
Figure 11B:
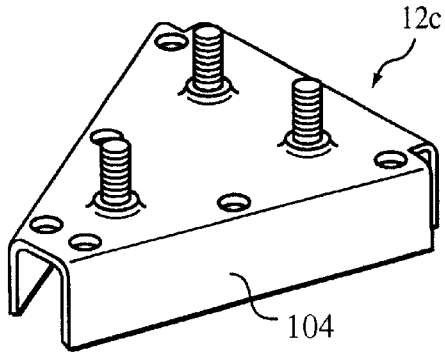
Figure 11C:
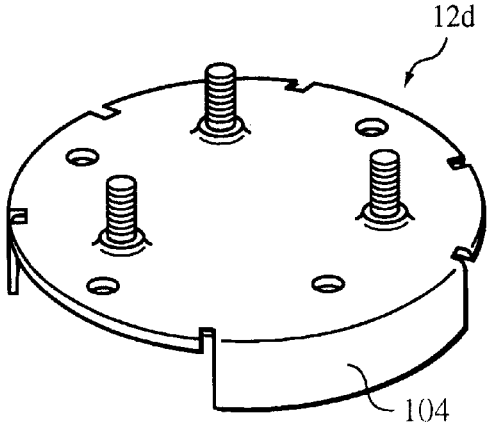

FIGS. 11A-11C illustrate various alternative shapes of a base member 12*b*-12*d*, respectively, having a peripheral vertical flange 104 for elevating the base member.

Figure 12A:
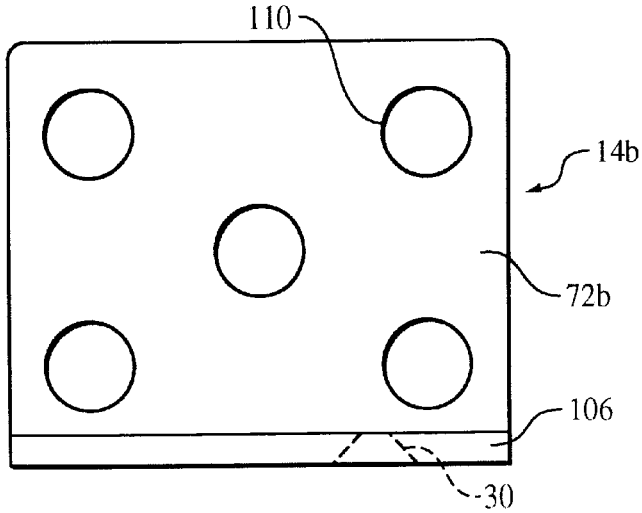
FIGS. 12A and 12B are two side views of an additional embodiment of a mount with an integral coupling component.
Figure 12B:
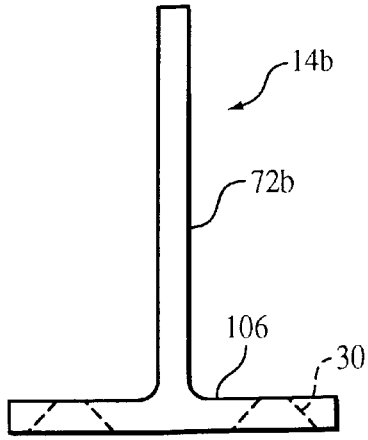
Figure 13A:
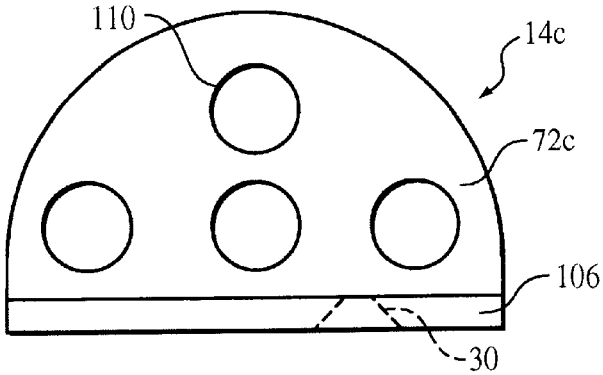
FIGS. 13A and 13B are two side views of an additional embodiment of a mount with an integral coupling component.
Figure 13B:
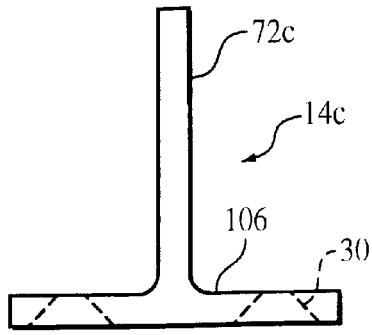

FIGS. 12 and 13 show various alternative embodiments of an attachment mount 14 including an integral coupling component. Referring to FIGS. 12*a* and 12*b*, mount 14*b* includes a plate 106 and an integral coupling component 72*b*. Plate 106 has through holes 30 for receiving bolts 24. Coupling component 72*b* is rectangular in shape and includes, e.g., five through holes 110 providing various options for attaching components to mount 14*b*. Referring to FIGS. 13*a* and 13*b*, mount 14*c* includes a plate 106 and an integral coupling component 72*c*. Plate 106 has through holes 30 for receiving bolts 24. Coupling component 72*c* is half-circular in shape and includes, e.g., four through holes 110 providing various options for attaching components to mount 14*c*.

Roof mount 10 also acts as a wind uplift prevention device. When functioning for this purpose alone, coupling component 72 of FIG. 1 can be omitted.

In each method of elevating the base member, i.e., whether a hollow base stand, tubes, or vertical flanges are employed, the surface area of the portion of the elevating structure covering the roof deck (corresponding to the areas of insulation that are removed or displaced to accommodate the elevating member) is less than the surface area of the side of the base member facing the roof deck, i.e., the surface area of side 18*b*, thus limiting the amount of insulation that is removed to accommodate the roof mount.

Roof mount 10 constitutes a solid, watertight mounting or anchoring device for membrane roofing. It is capable of receiving horizontal and vertical component parts such as safety railings or wires, attachment plates to which various mechanical fixtures such plumbing, cooling or heating units may be secured, or snow guard devices. Utilized without a receiving member, the base component also constitutes an effective prevention devise for wind uplift.

The roof mount of the invention can be used with other types of roofing such as wood and metal roofs. For these applications, membrane patch 13 is not needed. When applied to a corrugated metal roof, protrusions 50 on bottom surface 18*b* of base member 12 advantageously form dimples in the metal roofing, which act to limit leakage.

Figure 14:
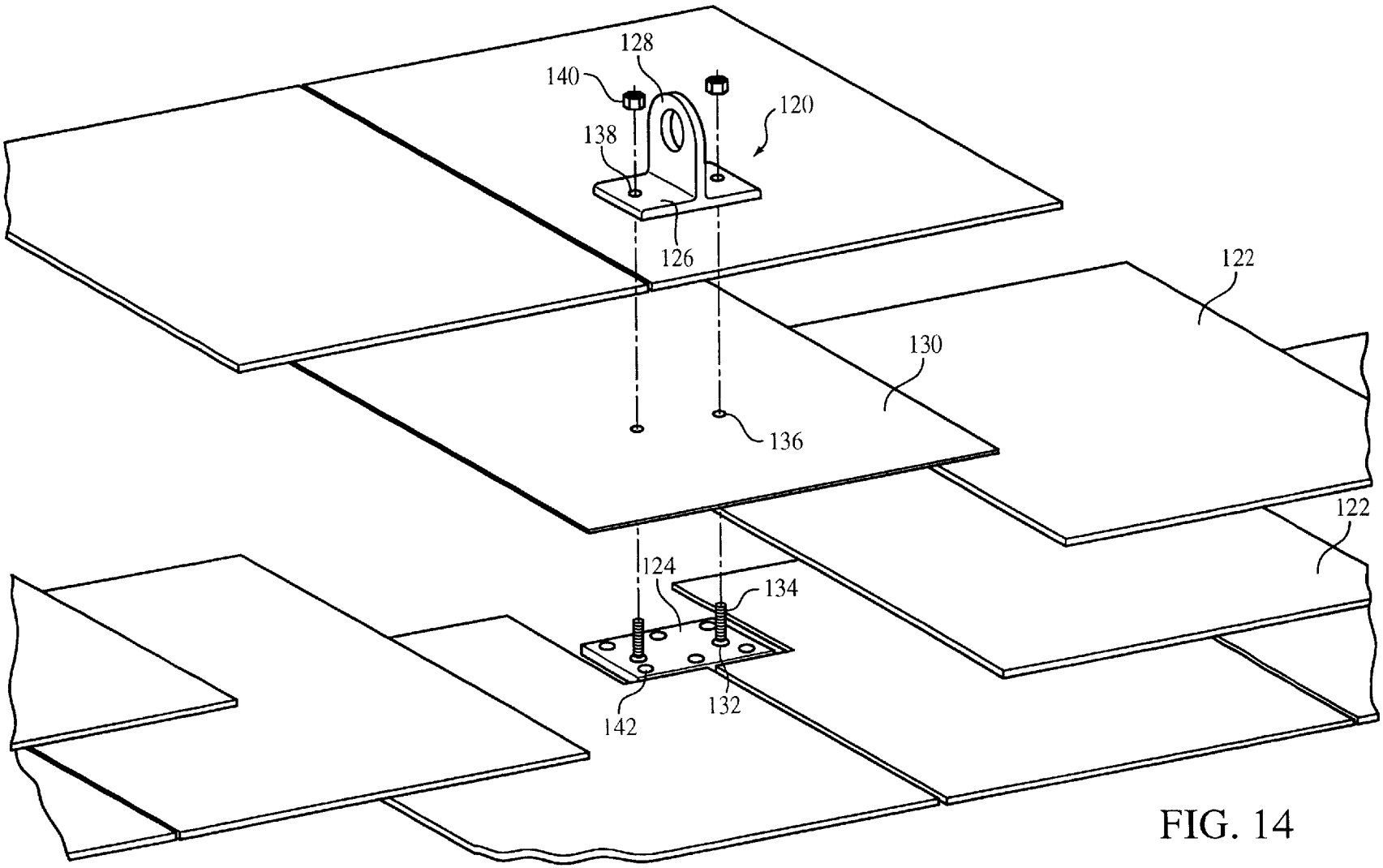
FIG. 14 is an exploded view of slate roofing incorporating a roof mount.
Figure 15:
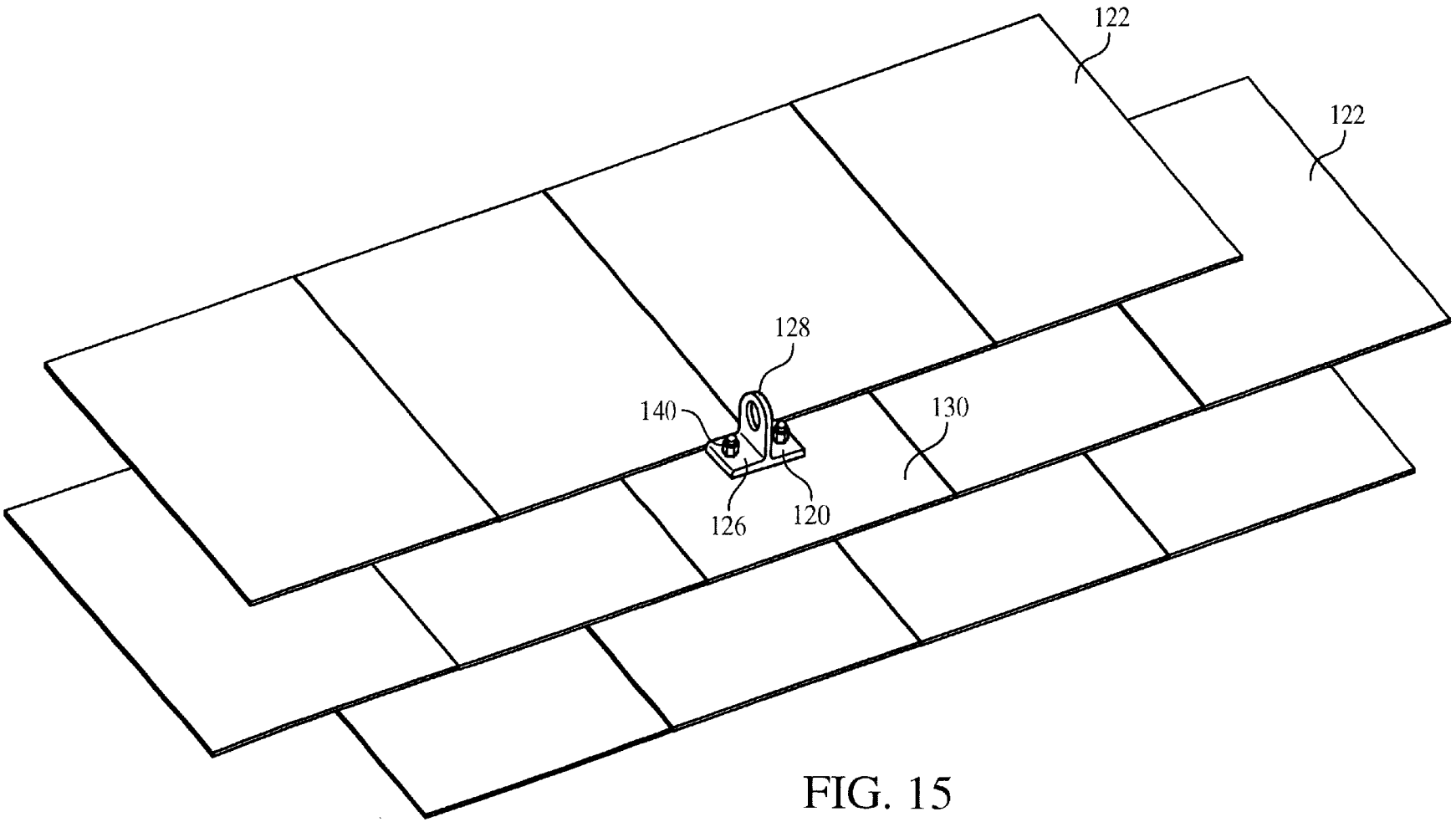
FIG. 15 is an assembled view of the slate roofing of FIG. 15.

Referring to FIGS. 14 and 15, a roof mount 120 for use with roofing such as slate, tile or shingles 122, includes a base member 124 and attachment mount 126 with integral coupling component 128. Instead of a membrane patch, a metal, e.g., copper, patch 130 is employed that replaces a single shingle 122. Base member 124 includes flared protrusions 132 and attachment bolts 134. Patch 130 has through holes 136 for receiving bolts 134, and mount 126 has through holes 138 for receiving bolts 134. Nuts 140 are threaded onto bolts 134 and tightened to secure mount 126 to base member 124. The securing of mount 126 to base member 124 compresses patch 130 creating a substantially leak proof compression fitting, as described above. Base member 124 includes holes 142 which receive attachment screws, not shown, for attaching base member 124 to the roof surface. The various elevation means described above can be employed with roof mount 120.

Other embodiments are within the scope of the following claims.

What is claimed is:

1. A roof mount, comprising:

a base member including a protrusion extending from a first surface of the base member and a centering protrusion extending from a second surface of the base member, the base member including a connecting element, an attachment mount defining a hollowed region for receiving the protrusion to form a compression fitting, wherein a substantially leak proof assembly is formed when the attachment mount is coupled to the base member by the connecting element with a sealing material placed between the attachment mount and the base member and the connecting element extends through the sealing material, and a spacer for extending the base member to a roof surface, the spacer defining a hollowed region for receiving the centering protrusion.

2. The roof mount of claim 1 wherein the connecting element extends from a region of the base member surrounded by the protrusion.

3. The roof mount of claim 1 wherein the connecting element comprises a threaded bolt.

4. The roof mount of claim 1 wherein the base member and the spacer define aligned through holes for receiving a screw for attaching the base member to a roof deck.

5. The roof mount of claim 1 wherein the spacer comprises a hollow base stand.

6. The roof mount of claim 1 wherein the spacer comprises a tube.

7. The roof mount of claim 1 wherein the base member defines a hole for receiving a screw for attaching the base member to a roof deck.

8. The roof mount of claim 1 further comprising a membrane patch forming the sealing material.

9. The roof mount of claim 1 further comprising a metal patch forming the sealing material.

10. The roof mount of claim 1 further comprising a coupling component attachable to the attachment mount for coupling a structure to the roof mount.

11. The roof mount of claim 13 wherein the coupling component is configured for attachment to the attachment mount by the connecting element.

12. The roof mount of claim 1 wherein the attachment mount further comprises an integral coupling component for coupling a structure to the roof mount.

13. The roof mount of claim 1, wherein the spacer has a surface area covering a roof deck less than a surface area of a side of the base member facing the roof deck.

14. A roof mount, comprising:

a base member including a protrusion extending from a first surface of the base member, the base member including a connecting element, an attachment mount defining a hollowed region for receiving the protrusion to form a compression fitting, wherein a substantially leak proof assembly is formed when the attachment mount is coupled to the base member by the connecting element with a sealing material placed between the attachment mount and the base member and the connecting element extends through the sealing material, and a spacer for extending the base member to a roof surface, the spacer including a hollow base stand.

15. The roof mount of claim 14 wherein the connecting element extends from a region of the base member surrounded by the protrusion.

16. The roof mount of claim 14 wherein the connecting element comprises a threaded bolt.

17. The roof mount of claim 14 wherein the base member and the spacer define aligned through holes for receiving a screw for attaching the base member to a roof deck.

18. The roof mount of claim 14 wherein the base member defines a hole for receiving a screw for attaching the base member to a roof deck.

19. The roof mount of claim 14 further comprising a membrane patch forming the sealing material.

20. The roof mount of claim 14 further comprising a metal patch forming the sealing material.

21. The roof mount of claim 14 further comprising a coupling component attachable to the attachment mount for coupling a structure to the roof mount.

22. The roof mount of claim 21 wherein the coupling component is configured for attachment to the attachment mount by the connecting element.

23. The roof mount of claim 14 wherein the attachment mount further comprises an integral coupling component for coupling a structure to the roof mount.

24. The roof mount of claim 14 wherein the spacer has a surface area covering a roof deck less than a surface area of a side of the base member facing the roof deck.

25. A roof mount, comprising:

a base member including a protrusion extending from a first surface of the base member, the base member including a connecting element, an attachment mount defining a hollowed region for receiving the protrusion to form a compression fitting, wherein a substantially leak proof assembly is formed when the attachment mount is coupled to the base member by the connecting element with a sealing material placed between the attachment mount and the base member and the connecting element extends through the sealing material, and a spacer for extending the base member to a roof surface, the spacer including a tube.

26. The roof mount of claim 25 wherein the connecting element extends from a region of the base member surrounded by the protrusion.

27. The roof mount of claim 25 wherein the connecting element comprises a threaded bolt.

28. The roof mount of claim 25 wherein the base member and the spacer define aligned through holes for receiving a screw for attaching the base member to a roof deck.

29. The roof mount of claim 25 wherein the base member defines a hole for receiving a screw for attaching the base member to a roof deck.

30. The roof mount of claim 25 further comprising a membrane patch forming the sealing material.

31. The roof mount of claim 25 further comprising a metal patch forming the sealing material.

32. The roof mount of claim 25 further comprising a coupling component attachable to the attachment mount for coupling a structure to the roof mount.

33. The roof mount of claim 32 wherein the coupling component is configured for attachment to the attachment mount by the connecting element.

34. The roof mount of claim 25 wherein the attachment mount further comprises an integral coupling component for coupling a structure to the roof mount.

35. The roof mount of claim 25 wherein the spacer has a surface area covering a roof deck less than a surface area of a side of the base member facing the roof deck.

36. A roof mount, comprising:

a base member including a protrusion extending from a first surface of the base member, the base member including a connecting element, an attachment mount defining a hollowed region for receiving the protrusion to form a compression fitting, wherein a substantially leak proof assembly is formed when the attachment mount is coupled to the base member by the connecting element with a sealing material placed between the attachment mount and the base member and the connecting element extends through the sealing material, and a spacer for extending the base member to a roof surface, the spacer including a side wall of the base member.

37. The roof mount of claim 36 wherein the connecting element extends from a region of the base member surrounded by the protrusion.

38. The roof mount of claim 36 wherein the connecting element comprises a threaded bolt.

39. The roof mount of claim 36 wherein the base member and the spacer define aligned through holes for receiving a screw for attaching the base member to a roof deck.

40. The roof mount of claim 36 wherein the base member defines a hole for receiving screw for attaching the base member to a roof deck.

41. The roof mount of claim 36 further comprising a membrane patch forming the sealing material.

42. The roof mount of claim 36 further comprising a metal patch forming the sealing material.

43. The roof mount of claim 36 further comprising a coupling component attachable to the attachment mount for coupling a structure to the roof mount.

44. The roof mount of claim 43 wherein the coupling component is configured for attachment to the attachment mount by the connecting element.

45. The roof mount of claim 36 wherein the attachment mount further comprises an integral coupling component for coupling a structure to the roof mount.

46. The roof mount of claim 36 wherein the spacer has a surface area covering a roof deck less than a surface area of a side of the base member facing the roof deck.

* * * * *